US005442870A

United States Patent [19]

Kochanowski

[11] Patent Number: 5,442,870

[45] Date of Patent: Aug. 22, 1995

[54] REFLECTIVE SIGN

[76] Inventor: George E. Kochanowski, 5066 NW. 90th Ter., Coral Springs, Fla. 33067

[21] Appl. No.: 119,291

[22] Filed: Sep. 8, 1993

[51] Int. Cl.[6] ..... G09F 13/16

[52] U.S. Cl. ..... 40/582; 40/612; 40/615; 359/527; 359/531; 359/547

[58] Field of Search ..... 40/582, 612, 615; 359/515, 527, 531, 547, 552

[56] References Cited

U.S. PATENT DOCUMENTS

| | | | |
|---|---|---|---|
| 625,464 | 5/1899 | Pfister . | |
| 1,580,921 | 4/1926 | Scherer . | |
| 1,696,489 | 12/1928 | Kahn | 40/615 |
| 2,167,149 | 7/1939 | Grote | 40/582 |
| 2,193,057 | 3/1940 | Carver | 40/615 |
| 2,379,741 | 7/1945 | Palmquist . | |
| 3,065,559 | 11/1962 | McKenzie . | |
| 3,409,344 | 11/1968 | Balint et al. . | |
| 3,494,912 | 2/1970 | Toyama et al. . | |
| 3,772,810 | 11/1973 | Kupperman et al. | 40/582 |
| 3,877,786 | 4/1975 | Booras et al. . | |
| 3,922,433 | 11/1975 | Patterson et al. . | |
| 3,934,065 | 1/1976 | Tung . | |
| 3,970,033 | 7/1976 | Lindner et al. | 359/547 |
| 3,994,086 | 11/1976 | Mizuochi . | |
| 4,025,674 | 5/1977 | Mizuochi . | |
| 4,082,426 | 4/1978 | Brown . | |
| 4,099,838 | 7/1978 | Cook et al. . | |
| 4,519,154 | 5/1985 | Molari, Jr. . | |
| 4,544,586 | 10/1985 | Molari, Jr. . | |
| 4,551,161 | 11/1985 | Rowland . | |
| 4,995,185 | 2/1991 | Cheng . | |
| 5,050,327 | 9/1991 | Woltman . | |

FOREIGN PATENT DOCUMENTS

| | | | |
|---|---|---|---|
| 0719817 | 10/1965 | Canada | 40/612 |

OTHER PUBLICATIONS

Reflectors Used in Highway Signs and Warning Signals, Parts I,II,& III G. A. Van Lear, Jr.; Oct., 1040 (J.O.S.A., vol. I).

*Primary Examiner*—Edward K. Look
*Assistant Examiner*—Christopher Verdier
*Attorney, Agent, or Firm*—Malin, Haley, DiMaggio & Crosby

[57] ABSTRACT

A retro-reflective sign is provided having a front face member attached to a back member. The face member has a plurality of cube corners disposed along its back surface. The sign can be of any shape or color and provides superior light reflection at night as compared to conventional signs. Thus, the sign can be easily seen while driving at night. In an alternative embodiment, the cube corners are disposed along the inner surface of the back member. The front face member or the entire sign can be coated with a silicone material to provide added protection to the sign from scratching and vandalism.

19 Claims, 4 Drawing Sheets

REFLECTIVE SIGN

BACKGROUND OF THE INVENTION

1. Field of the Invention

This invention relates generally to reflectors and in more particular to an improved reflective sign for uses such as roadside traffic signs.

2. Background of the Invention

With the dawn of the automobile came the need for traffic control devices. Originally, each traffic sign was cut to a unique shape for identification. Since electricity was not wide spread, painted signs were used for traffic control. With the increase of automobile use around the clock, the traffic signs began to be painted with as reflective a paint available for viewing at nighttime. Initially, the reflective paint was used on wooden signs and then on more durable signs constructed of metal, including laminated signs. Presently, roadway signs have been constructed using tiny glass beads added to the paint to increase overall reflectivity.

Examples of the use of glass beads include U.S. Pat. No. 2,379,741 issued to McKenzie; U.S. Pat. No. 3,065,659 issued to Palmquist; U.S. Pat. No. 3,494,912 issued to Mitsuo Toyama et al.; U.S. Pat. No. 3,877,786 issued to Booras et al.; U.S. Pat. No. 3,922,433 issued to Patterson et al.; U.S. Pat. No. 3,934,065 issued to Tung; U.S. Pat. No. 3,994,086 issued to Mizuochi; U.S. Pat. No. 4,025,674 issued to Mizuochi; U.S. Pat. No. 4,082,426 issued to Brown; U.S. Pat. No. 4,099,838 issued to Cook et al.; U.S. Pat. No. 4,519,154 issued to Molari, Jr.; U.S. Pat. No. 4,544,586 issued to Molari, Jr.; U.S. Pat. No. 4,555,161 issued to Rowland; and U.S. Pat. No. 4,995,185 issued to Cheng.

The current state of the art is to put the beads on a paper or web backing and cover with a thin laminate. The other side of the paper or web is coated with a special adhesive so it will stick to the aluminum. A further enhancement is to use a heat activated adhesive to improve the bonding. In this process, the aluminum is heated and the paper or webbing sticks to it. Signs out in the field use stickers put on metal backing, and are painted with a message, design, symbol, etc. or combinations thereof, i.e. STOP, WRONG WAY. Once the sticker is on, the sign is ready for stencil and paint. However, when painting the sign, a minimal amount of paint is utilized to avoid covering up the reflective media. Presently, the colorant or paint is included on the inside of the laminate. However, during the heating process the paint on the inside the sticker becomes damaged. Additional damage occurs during the installation in the field. When the sign is fastened to a sign post, the bolt cuts small slits into the laminate. Thus, moisture is allowed to get into the sign, and with normal daily temperature swings, the signs begins to de-laminate and within weeks, the sign is ruined.

Other examples of reflective roadway signs and markers include the following:

(1) U.S. Pat. Nos. 5,050,327 issued to Woltman discloses a sign having a face bearing an informational legend thereon. The face is made up of one or more legend portions and one or more background portions. The legend and background portions define cross-sectional segments of the sign. At least part of at least one of the legend segment or background segment is both retro-reflective and translucent. Typically, the legend and background portions of the face are of contrasting colors to enhance the legibility of the information displayed on the sign. The backing member of the sign must be translucent or transparent in at least any segment of the backing member which is part of the translucent segment of the sign. This sign is better seen at night than conventional signs only when the sign is backlit.

(2) U.S. Pat. No. 3,409,344 issued to Balint et al. discloses a roadway reflector comprising a hollow housing which has inclined side and end walls and a flat top wall. The housing is molded in situ about the periphery of previously molded reflective inserts so that the inserts are in the end walls. The inserts have substantially flat outer surfaces and a plurality of retro-reflective prisms on the inner surfaces thereof, the axes of the prisms forming an angle with the plane of the insert and in turn with the pavement when the marker/reflector is in position such that the light beams from the automotive vehicle are reflected back to the eyes of the driver.

Though nearly a century has passed since the use of automobiles as way of transportation began, adequate traffic signs, especially for easy viewing at night, are still missing in the art. Thus, what is needed in the art is a sign having increased reflective means for greater viewing at nighttime as compared to present conventional signs. In addition, the sign needs to be more durable and able to last longer than signs presently in use. It is therefore, to the effective resolution of the aforementioned problems and shortcomings that the present invention is directed.

SUMMARY OF THE INVENTION

Generally, the present invention relates to a reflective sign, constructed of plastic, and having a face member and a back member. More specifically the present invention uses the technology of retro-reflectance. Reflectors which return light into the immediate neighborhood of its source, regardless of the position of that source, are call retro-directive reflectors. Literally, retro-directive reflection means exactly reversing the direction of each ray of light, sending it back along either its original path or a parallel one. An ideal retro-directive reflector would thus return most of its light received from a particular source back into the source itself. However, the ideal retro-directive reflector constitutes a theoretical limiting case of no practical value. The practical retro-directive reflector differs from the ideal one in giving to the return beam the conical shape required to reach the eyes of an observer.

One type of retro-directive reflector is the triple reflector. The triple reflector has three plane reflecting surfaces arranged so that each is perpendicular to the other two, e.g. similar to the floor and two adjacent walls of a room meeting at a corner. Thus, any ray of light which has been reflected successively from all three surfaces will be exactly reverse in direction.

Using a stop sign as an example, the face member is molded with the appropriate amount of red color pigment of the sign, and the area where the words or symbols and the border are kept clear or water white. The entire back of the face member contains reflective means such as cube corners. The plastic can have ultraviolet (UV) stabilizers added to inhibit fading of the color pigment from the sunlight. The back member can be virtually opaque. The interior finish of the back member is very smooth and glossy and can be almost mirror like. Light that passes through the face member gets reflected back through the sign and provides a near back lit effect, thus, increasing one capability to see the sign in the dark. Lastly, the sign can be coated with a silicone based product. This coating will increase the UV stability and also makes the surface of the sign harder to reduce the amount of chalking, dusting and scratches. The silicone coating also makes the sign more vandal resistant as paints will not permanently adhere to the treated surface.

Accordingly, it is an object of the present invention to provide a reflective sign which will be more brighter at night than conventional reflective signs.

It is another object of the present invention to provide a reflective sign which is easily seen at night as compared to conventional reflective signs.

It is an additional object of the present invention to provide a reflective sign which will last longer and is more durable than conventional reflective signs.

It is yet another object of the present invention to provide a reflective sign which is constructed from plastic.

It is a further object of the present invention to provide a reflective sign which can be completely recycled to make replacement reflective signs.

It is still another object of the present invention to provide a reflective sign which is relatively low in cost and easy to manufacture.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to he drawings in which.

DETAILED DESCRIPTION OF THE PREFERRED EMBODIMENT

Figure 1:
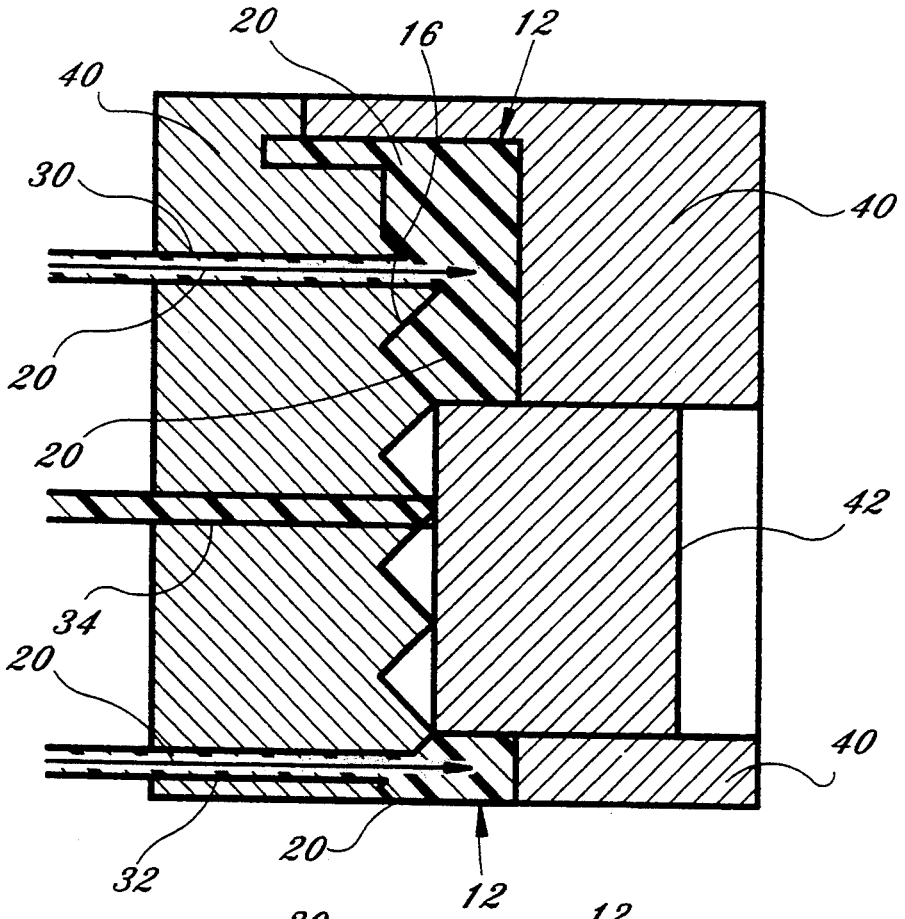
FIG. 1 is a front view showing the first step of the first molding process for the front face member.

As seen in the drawings the present invention shows an improved reflective sign constructed from a molding process to be discussed below. The sign, generally shown at 10, is constructed from two pieces of plastic and includes a front or face portion 12 and a back portion 14. Preferably, a strong but flexible plastic is utilized in the construction, i.e. a polycarbonate such as the LEXAN brand. However, other plastics and materials which have similar characteristics to polycarbonates may be utilized for the construction of the reflective sign. The designed thickness of the face member 12 not only provides the sign 10 with rigidity, but it also provides the area to incorporate cube corners 16, which increase the reflectivity of the sign.

Figure 2:
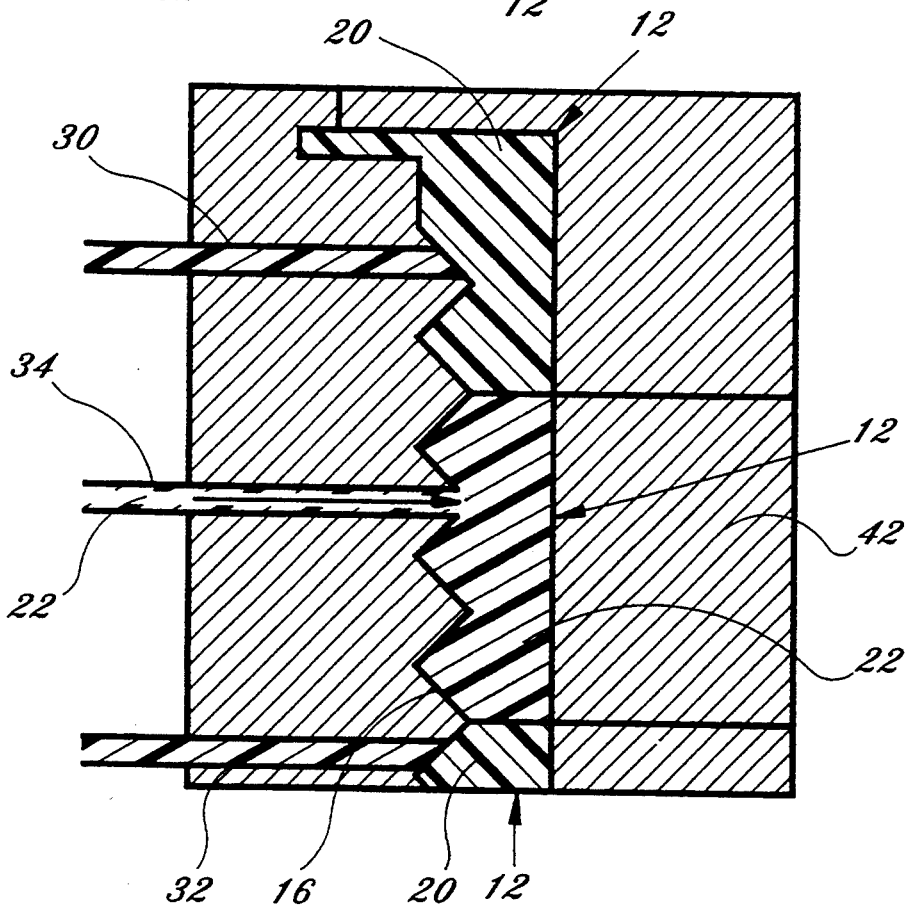
FIG. 2 is a front view showing the second step of the first molding process for the front face member.
Figure 3:
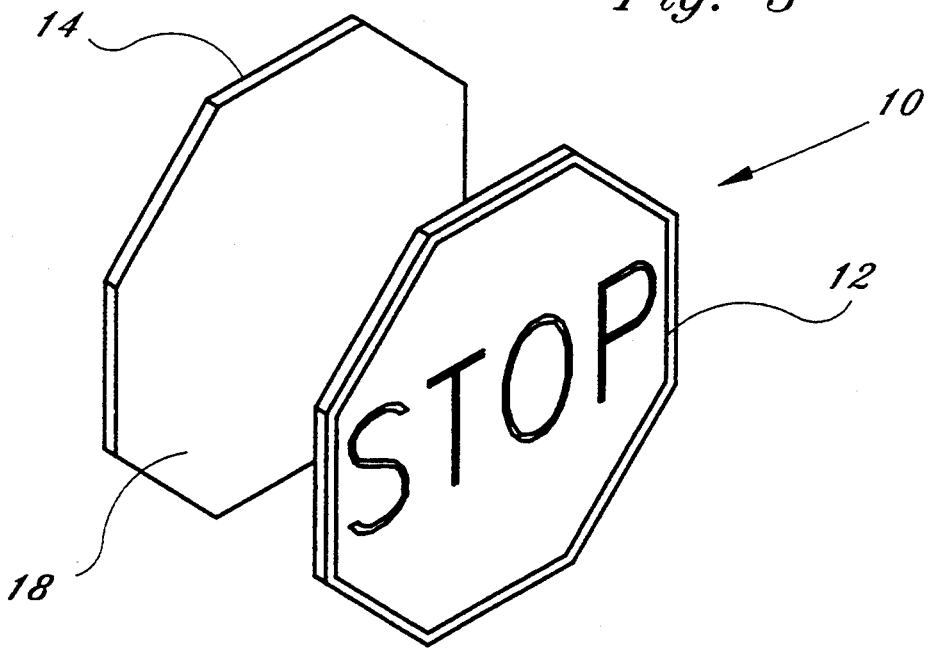
FIG. 3 is an exploded view of the present invention.
Figure 4:
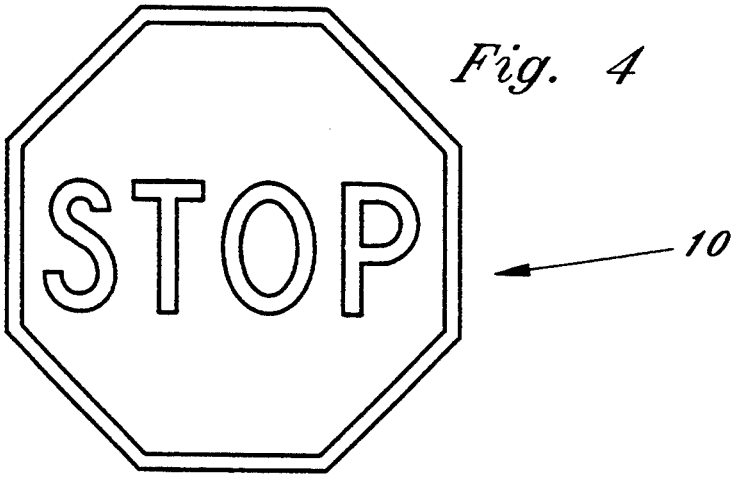
FIG. 4 is a front view of the present invention.
Figure 5A:
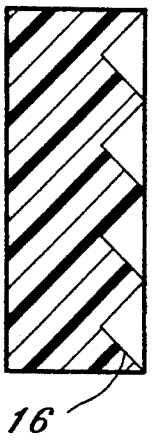
FIG. 5A is a side view of a portion of the cube corners in accordance with the present invention.
Figure 5B:
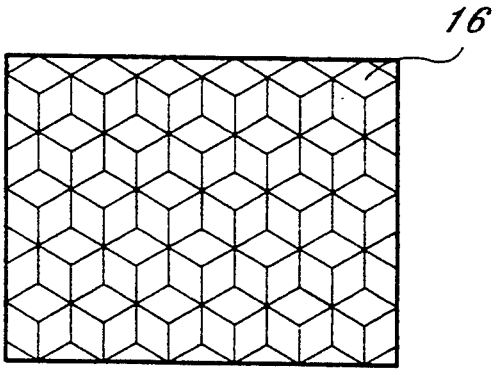
FIG. 5B is a front view of the cube corners shown in FIG. 5A.
Figure 6:
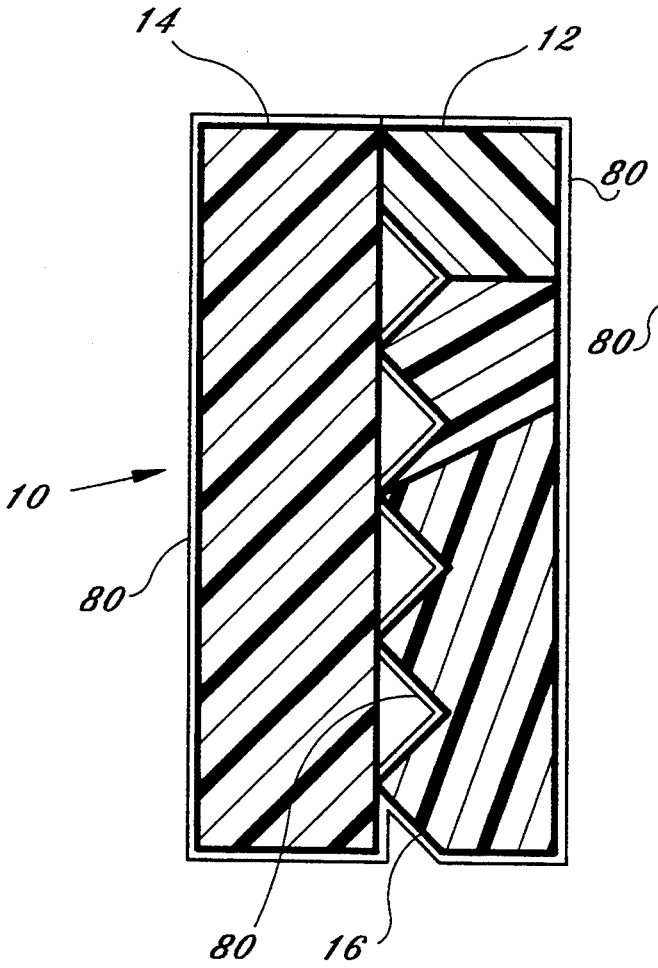
FIG. 6 is a side view showing a portion of the first embodiment of the present invention having three different colors.

Now describing the sign construction process for a sign requiring two colors (FIGS. 1 and 2), a first polycarbonate 20 is injected through cavities 30 and 32 into the mold 40 to the areas of the face of the sign according to the design of the sign. Specifically, one of the two colored plastics is injected. This will be referred to as the 1st shot. It is to be understood that more than two cavities can allow the flow through of the first polycarbonate, and which cavities are used and the number of cavities is determined by the design of the sign. The area where the other color for the sign will go, and the end of the cavities associated with such area, are blocked off by blocking or separating means 42 during the injection of the first color polycarbonate to avoid any of the first color from entering this area of the design. After the first plastic (polycarbonate) 20 sets up or hardens, the mold is manipulated to accommodate the flow of the other colored or clear plastic. As seen in FIG. 2, the blocking means 42 is pulled back to open cavity 34 and allow the second plastic 22 to go through and complete the construction of the face member 12. After the first plastic 20 hardens it acts as a blocking member to cavities 30 and 32, thus not allowing the second plastic when injected to go through cavities 30 and 32 and enter the area of the design designated for the first plastic 20.

The mold 40, now altered by the hardening of the first plastic 20 and the pulling back of the separating means 42, accepts the second plastic 22 to fill the available cavities associated with the area of the face of the sign designated for the second plastic. This will be referred to as the 2nd shot. In this example only two different color plastics are required, however, it is to be understood that this process could be utilized for numerous amounts of different color plastics utilizing appropriated amounts of blocking members 42 and previously hardened color or clear plastics to only allow the flow of additional color or clear plastics into the mold at designated areas of the face of the sign according to the sign design. In such cases, the additional plastics would be referred to as the 3rd shot, 4th shot, etc. Once all the plastics have cooled the face member 12 of sign 10 is removed from the mold 40.

An alternative process to the one described above is to remove the 1st shot (first color plastic 20 after it has hardened) and move it to a second independent mold (not shown) for injection of the 2nd shot (second color plastic 22). Since the two shots are from the same base material (only differing in color pigment), the two shots melt into each other making the face member 12 into one final piece. The face portion 12 is molded with the appropriate amount of color pigment, and the area where the words or symbols are is kept clear. From the mold design, the entire back of the face member 12 contains a plurality of cube corners 16.

However, in either of these process, the mold is designed to provide a plurality of cube corners 16 on the entire inner surface of the face member 12. Though it is preferred to have the cube corners 16 disposed on the entire back surface of face member 12, the present invention is not limited to such. Thus, it is within the scope of the invention to provide a plurality of cube corners 16 on a substantial, but not entire, portion of the back surface of the front face member 12. Each cube corner 16 is a form of the triple reflector described above. The cube corners 16 are a mosaic of 90-degree triangular pyramids which are formed from the mold design to provide excellent night time visibility of the sign.

Once the face member 12 is removed from the mold 40 it is attached to a back member 14. Preferably, the back member 14 is previously stamped to the correct shape of the sign 10 to accept the face member 12. The face member 12 can be attached to the back member 14 by several different methods including clips, glue, adhesive, snaps, ultrasonic means. However, it is to be understood that the invention is not limited to the these identified attaching methods and that other conventional attaching methods not listed are within the scope of the present invention.

Finally, the face member 12 of the sign 10 is coated with a Silicone hardener 80, and cured. In addition to the face member 12, to provide more protection to sign 10, the entire sign can be coated with the Silicone hardener 80. The Silicone coating seals the sign 10, and protects it from the UV light of the sun. The silicone coating also makes the surface harder, making sign 10 vandal resistant while keeping its outward appearance glossy and clean. Thus, the present invention provides a more reflective, durable sign as compared to conventional signs.

Thus, the sign is preferably constructed from all plastic. There is no paint, aluminum backing, reflective sheeting or sticker. The entire face member 12 of sign 10 is the sign and not a sticker adhered to a backing plate such as metal, wood or even plastic, as with prior art signs, i.e. STOP signs, etc. The letters, symbols, and colors of the sign design are molded together out of the plastic (polycarbonate) with the inner or back surface of the face member 12 molded into cube corners 16. Sign 10 has excellent retro-reflecting properties as compared to prior art signs. Furthermore, scratching sign 10 will not inhibit the retro-reflectance properties as the cube corners 16 are on the inside, and the coating materials utilized do not readily accept exterior paint materials.

For illustrative purposes only, in describing the present invention, a stop sign will be used, where appropriate, as the example for the sign design. However, as will be seen below, the present invention can be used to construct any type of sign, regardless of shape or color, requiring retro-reflectance.

Using the stop sign as an example, the molding process will now be described. The polycarbonate (having a red pigment) is injected through cavities into a mold. Thus the face member 12 is molded with the appropriate amount of red pigment, and the area where the word (STOP) is located on the face is kept clear. Once hardened, a clear plastic (polycarbonate) is injected through the cavities into the areas where the word STOP is located as well as the border area of the sign. The hardened red polycarbonate acts as a blocking means to prevent the clear plastic from entering these areas of the face member 12. The entire inner or back surface of the face member is molded into cube corners 16.

In use, the biggest concern with stop signs is that the red pigment will fade due to the ultraviolet (UV) light coming from the sun. However, the plastic (polycarbonate) will have UV stabilizers added to inhibit this fading. Additionally, the thickness of the face member 12 is such that there is significantly more red pigment that in a common STOP sign that simply paints a red coating on a reflective sticker. The additional pigment also increases the life of the sign 10 in the field.

The back member 14 of the STOP sign 12 is also made out of plastic, preferably Polycarbonate, and is virtually opaque. The interior finish of the inner surface 18 of the back member 14 is very smooth and glossy, almost mirror like to create a reflective surface. Alternatively, a MYLAR brand film, shiny paper or metallic layer may be disposed on the inner surface of the back member 14 to create the reflective surface. In this way any light that passes through the face member 12, will get reflected back through the sign to provide a near "back lit" effect. Thus, one's capability to see the sign 10 in the dark is greatly increased. Furthermore, an electrical light source can also be provided on the sign to increase the amount of light being reflected back from the glossy or mirror like surface. Finally, the entire sign 10, can be coated with a silicone based product. The silicone coating increases the UV stability of the red pigment and the polycarbonate itself. An additional advantage is that the silicone coating makes the surface of sign 10 harder, thus reducing the amount of chalking, dusting, and scratches to the sign 10. The silicone coating also makes the sign vandal resistant as some paints will not permanently adhere to the treated surface.

In a first alternative embodiment the reflective surface (i.e. MYLAR brand film, shiny paper or metallic layer, etc.) can be disposed or deposited onto cube corners 16 to provide special reflection. After applying the reflective surface to the cube corners 16, the cube corners 16 can be sealed to eliminate the need for a back piece.

In a second alternative embodiment (FIG. 7), the cube corners are disposed on the back member 14 instead of the face member of the sign. Thus, the inner surface and the outer surface of the face member are basically flat. The process for making the face member is still the same as described above except for the cube corners design in the mold is eliminated. This alternative embodiment has all of the advantages of the first embodiment of the present invention.

In a third embodiment, the face member is clear or water white and either the inner surface of the back member or the inner surface of the face member contain .the cube corners. In this embodiment the message that the sign conveys would be painted on the face member. Similar to the above, the back member could be eliminated and the reflective surface deposited onto the cube corners.

A second alternative process for the sign design involves the use of prefabricated mold shapes 50 to separate the different colors of the sign design. Using a STOP sign again as an example (FIGS. 7 through 10), the prefabricated shapes 50 are constructed by injecting plastic into a mold to make the outline of the letters, design or other symbol (e.g. the letters S, T, O and P and the outer border region of the STOP sign) according to the sign design. The prefabricated shapes provide supporting walls, and a means to segregate or separate the colors used for the sign design. In this process the separating means 42 described above are no longer needed as the prefabricated shapes inherently provide such function.

To make the prefabricated shapes 50, plastic is injected into a first mold designed to make the outline of the letters and symbols required by the sign design. The plastic material and color used for the prefabricated shapes 50 is the same as the plastic used for the face member 12 of the sign. Thus, the plastics will blend in perfectly with each other and will make a seamless joint. Once cooled, and cleaned of residual plastic, the shapes are inserted into a second mold to make the face member of the sign.

Figure 7:
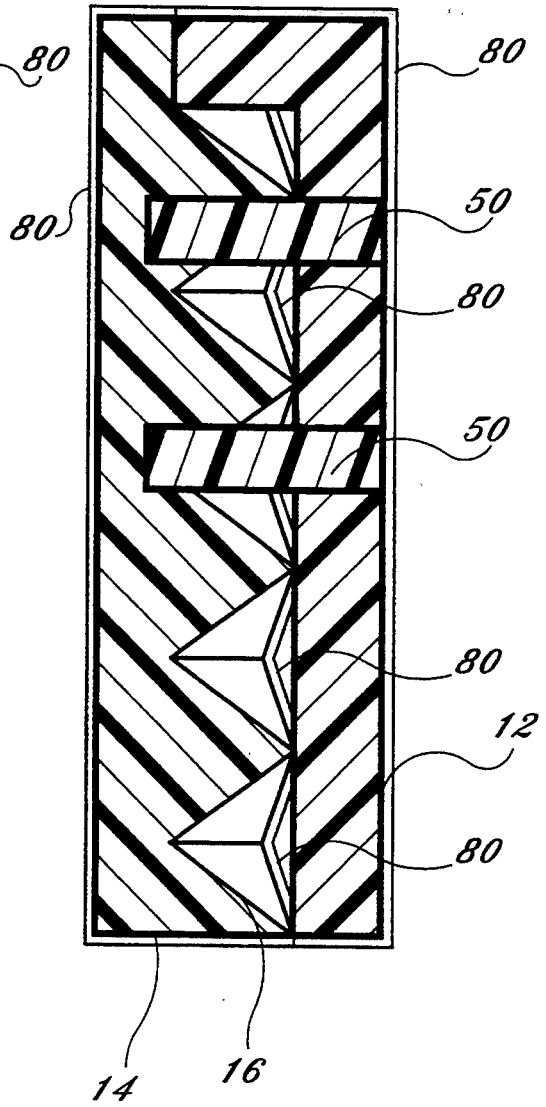
FIG. 7 is a side view showing a portion of the second embodiment of the present invention.
Figure 8:
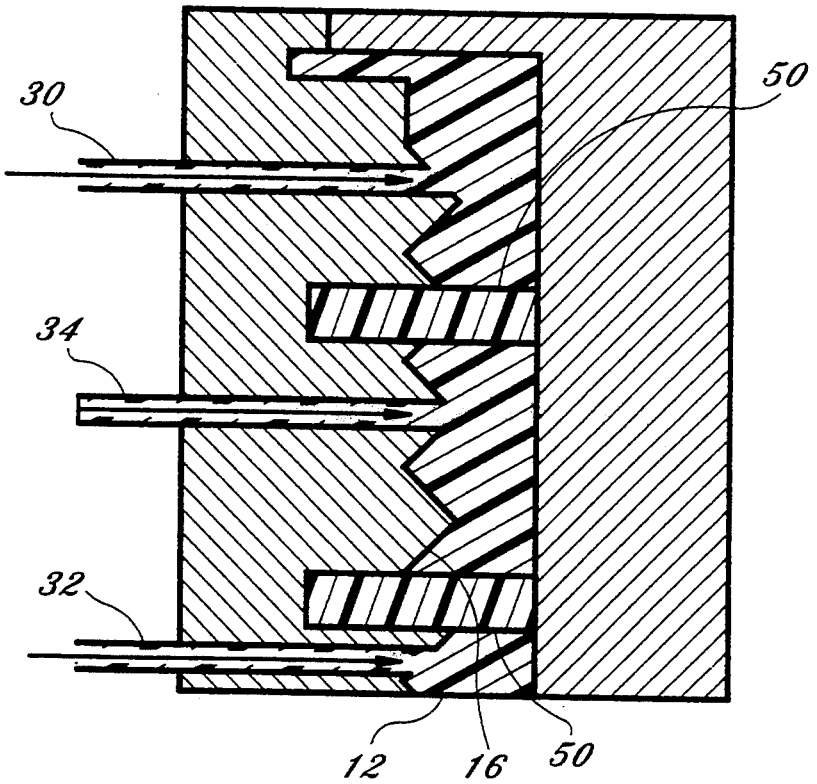
FIG. 8 is a front view showing the an alternative molding process for the front face member.
Figure 9:
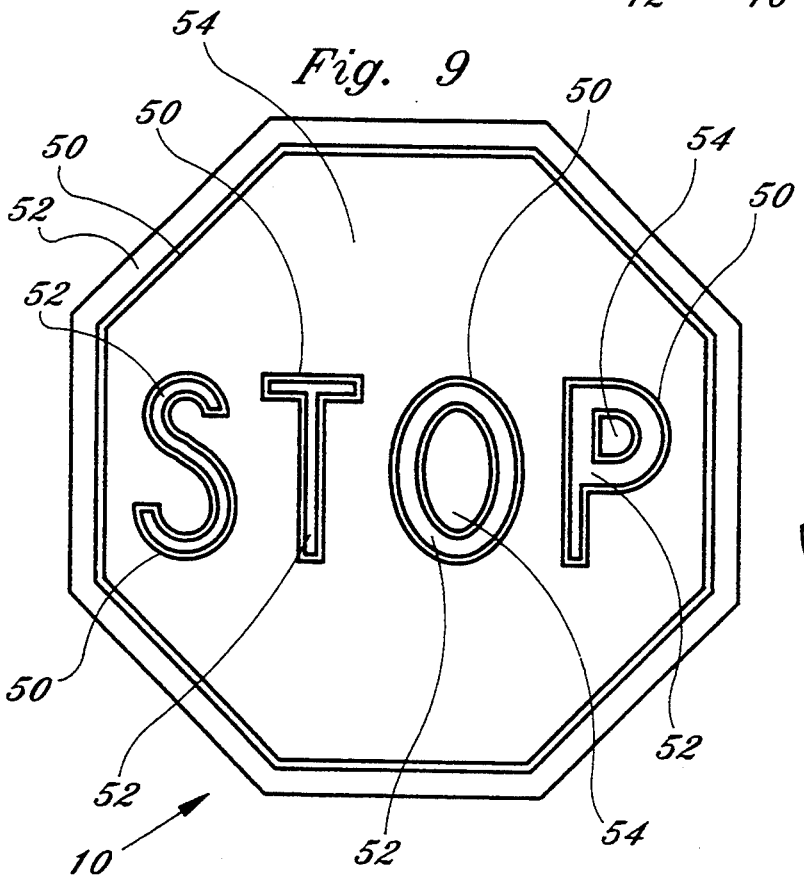
FIG. 9 is a front view of the present invention constructed from the alternative molding process of FIG. 8.
Figure 10:
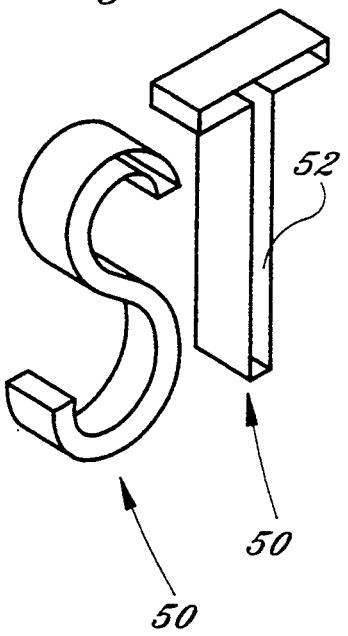
FIG. 10 is a perspective view of two prefabricated letters in accordance with the alternative molding process.

Using the stop sign as an example, by the use of the prefabricated shapes 50, both the red plastic and the clear plastic can be injected into the mold at the same time. The clear plastic is poured within the area 52 between the separating walls of the letters "S", "T", "0" and "P" and the outer borders, while the red plastic is poured within the area designated 54. In this second mold the cube corners 16 are constructed in a similar fashion as to other processes described above. The cube corners 16 can be disposed on either the face member 12 (FIG. 8) or the back member of the sign (FIG. 7). When disposed on the face member 12, the cube corners are disposed on the entire inner surface of the face member 12 except where the prefabricated shapes 50 are located. However, this area is minimal and does not affect the reflectivity properties of the sign 10.

Thus, this second alternative process provides a more practical method of constructing the retro-reflective sign of the present invention. Additionally, the prefabricated shapes 50 provide additional areas for joining the face member 12 to the back member of the sign 10, thus, increasing the rigidity of the sign 10.

In operation as a STOP sign, the light, such as a car's headlights at night, will hit the sign. Some light will immediately reflect back from the red and water white or clear areas of the STOP sign. However, some light does not get reflected back but passes through the face member 12 of the STOP sign through tiny cracks between the cube corners and becomes captured between the back member and the face member. This light hits the glossy or mirror like finish of the inner surface of the back member and reflects back and hits the cube corners. The cube corner diffuses the lights, held captive between the back member and the face member, in various direction to allow the driver of the automobile to easily see the STOP sign. The present invention provides nearly 50% more reflective area than a sign of equal outside dimensions utilizing the prior art glass balls for reflective purposes. Thus, the present invention allows the driver to see the STOP sign well in advance of approaching the STOP sign in order to safely stop before entering the corresponding intersection or roadway. Furthermore the STOP sign will stay red much longer than conventional STOP signs due to its larger amount of red pigment. As the sign, can be constructed entirely from plastic or thermoplastic, it is recyclable and thus, can be reused to construct additional signs in accordance with the present invention. The silicone coating applied to the sign helps to prevent destruction of the sign from the likes of vandalism, scratching, sunlight, etc.

The present invention can be utilized for any sign which requires retro-reflectance, regardless of the size of the sign. The present invention can accommodate any symbols in the face portion of the sign, including any letters, and can be any shape or color, or any combination of shapes or colors. Therefore, the present invention can be utilized for any traffic sign as well as any sign requiring retro-reflectance. However, the present invention is not limited to signs and can be utilized for other objects and items requiring retro-reflectance. Further, though the present invention has been described with the use of cube corners as the reflective means, it is to be understood that other triple reflectors as well as reflective means may be utilized in place of the cube corners. It should also be understood that other design combinations using the features of the present invention are possible and are within the scope of this invention. Furthermore, while it is preferred that the entire sign be constructed from plastic, this is not limiting, and other materials such as glass or fiberglass may be utilized.

Thus, it is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim Is:

1. A retro-reflective sign providing for increased conspicuity and legibility of said sign during viewing at nighttime, comprising:

a face member constructed from polycarbonate and having an outer surface and an inner surface;

a plurality of cube corners disposed along the inner surface of said face member; and a virtually opaque back member constructed from polycarbonate and operatively associated with said face member, said back member having an inner surface and an outer surface, the inner surface of said back member having a smooth and glossy finish.

2. The retro-reflective sign of claim 1 wherein at least a portion of said face member is coated with a surface hardener.

3. The retro-reflective sign of claim 1 wherein at least a portion of said face member and said back member are coated with a surface hardener.

4. A retro-reflective sign providing for increased conspicuity and legibility of said sign during viewing at nighttime, comprising:

a face member having an outer surface and an inner surface;

a plurality of cube corners disposed along the inner surface of said face member; and a back member operatively associated with said face member, said back member having an inner surface and an outer surface, the inner surface of said back member having a smooth and glossy finish to provide reflective means in addition to said plurality of cube corners.

5. A retro-reflective sign providing for increased conspicuity and legibility of said sign during viewing at nighttime, comprising:

a single layer face member incorporating information therein and having an outer surface and an inner surface; and a back member operatively associated with said face member, said back member having an inner surface and an outer surface, the inner surface of said back member having reflective means operatively associated therewith.

6. The retro-reflective sign of claim 5 wherein at least a portion of said face member is coated with a surface hardener to help reduce fading of and extending the useful life of said sign.

7. The retro-reflective sign of claim 5 wherein at least a portion of said face member and said back member are coated with a surface hardener to help reduce fading of and extending the useful life of said sign.

8. The retro-reflective sign of claim 5 wherein said inner surface of said face member has a smooth and glossy finish to provide a second reflective means.

9. The retro-reflective sign of claim 5 wherein said reflective means is a plurality of cube corners disposed along the inner surface of said back member.

10. The retro-reflective sign of claim 5 wherein said face member and said back member are constructed from plastic.

11. The retro-reflective sign of claim 5 wherein said back member is virtually opaque.

12. A retro-reflective sign having a desired shape and providing for increased conspicuity and legibility of said sign during viewing at nighttime, comprising:

a single layer face member incorporating information therein and having an outer surface and an inner surface, the inner surface of said face member incorporating reflective means operatively associated therewith, said face member molded into the desired shape of said sign; and a back member operatively associated with said face member, said back member having an inner surface and an outer surface, said sign having a front side and a back side, wherein said information is seen only when viewing said sign from said front side;

wherein the inner surface of said back member has a smooth and glossy finish to provide a second reflective means.

13. The retro-reflective sign of claim 12 wherein at least a portion of said face member is coated with a surface hardener to help reduce fading of and extending the useful life of said sign.

14. The retro-reflective sign of claim 12 wherein at least a portion of said face member and said back member are coated with a surface hardener to help reduce fading of and extending the useful life of said sign.

15. The retro-reflective sign of claim 12 wherein said reflective means is a plurality of cube corners incorporated within said face member along the inner surface of said face member.

16. The retro-reflective sign of claim 12 wherein said face member and said back member are constructed from plastic.

17. The retro-reflective sign of claim 12 wherein said back member is virtually opaque.

18. A retro-reflective sign having a desired shape and providing for increased conspicuity and legibility of said sign during viewing at nighttime, comprising:

a single layer face member incorporating information therein and having an outer surface and an inner surface, the inner surface of said face member incorporating reflective means operatively associated therewith, said face member molded into the desired shape of said sign; and a back member operatively associated with said face member, said back member having an inner surface and an outer surface, said sign having a front side and a back side, wherein said information is seen only when viewing said sign from said front side;

wherein said reflective means is a plurality of cube corners disposed along the inner surface of said face member and the inner surface of said back member, said cube corners disposed along the inner surface of said back member acting as a secondary reflector.

19. The retro-reflective sign of claim 18 wherein the inner surface of said face member has a smooth and glossy finish to provide a second reflective means.

* * * * *